United States Patent [19]

Ooishi et al.

[11] Patent Number: 4,723,726

[45] Date of Patent: Feb. 9, 1988

[54] ROTATING SPEED CONTROL DEVICE OF A ROTARY TYPE ELECTROSTATIC SPRAY PAINTING DEVICE

[75] Inventors: Shogo Ooishi; Naoki Yamada; Hitoshi Takeuchi, all of Toyota, Japan

[73] Assignee: Toyota Jidosha Kabushiki Kaisha, Toyota, Japan

[21] Appl. No.: 868,057

[22] Filed: May 29, 1986

[30] Foreign Application Priority Data

Jun. 11, 1985 [JP] Japan ..... 60-086867[U]

[51] Int. Cl.[4] ..... B05B 3/10

[52] U.S. Cl. ..... 239/703; 239/223; 415/16; 415/43; 324/175

[58] Field of Search ..... 416/341; 415/17, 30, 415/16, 36, 40, 43; 329/175, 161; 239/703, 223, 224, 68, 67

[56] References Cited

U.S. PATENT DOCUMENTS

| | | | |
|---|---|---|---|
| 3,096,494 | 7/1963 | Senard | 324/175 |
| 3,172,263 | 3/1965 | Quick et al. | 415/16 X |
| 3,654,553 | 4/1972 | Mary et al. | 324/175 |
| 4,323,197 | 4/1982 | Morishita et al. | 239/223 X |
| 4,361,288 | 1/1982 | Fukuda et al. | 239/703 |
| 4,368,853 | 1/1983 | Morishita et al. | 239/703 |
| 4,502,045 | 2/1985 | Fromm | 324/175 X |
| 4,638,155 | 1/1987 | Dorr | 324/175 X |

*Primary Examiner*—Andres Kashnikow
*Assistant Examiner*—Kevin Patrick Weldon
*Attorney, Agent, or Firm*—Oblon, Fisher, Spivak, McClelland & Maier

[57] ABSTRACT

A rotary type electrostatic spray painting device including a rotary shaft driven by an air turbine. A reflecting face portion and a non-reflecting face portion are formed on the rear end face of the rotary shaft. A rotating speed sensor is arranged adjacent to the rear end face of the rotary shaft to detect the rotating speed of the rotary shaft from light reflected from the reflecting face portion. The amount of pressurized air fed into the air turbine is controlled in response to the output signal of the rotating speed sensor so that the rotating speed of the rotary shaft becomes equal to a desired rotating speed.

9 Claims, 3 Drawing Figures

ROTATING SPEED CONTROL DEVICE OF A ROTARY TYPE ELECTROSTATIC SPRAY PAINTING DEVICE

BACKGROUND OF THE INVENTION

1. Field of the Invention

The present invention relates to a rotating speed control device of a rotary type electrostatic spray painting device.

2. Description of the Related Art

A rotary type electrostatic spray painting device which is equipped with a rotary shaft having a spray head and driven by an air turbine is known (for example, Japanese Unexamined Patent Publication No. 57-113860). Where such a rotary type electrostatic spray painting device is used in a painting process for a vehicle body, it is necessary to frequently change the colors of paint to be painted by such painting device. In addition, since an optimum rotating speed of the spray head exists for each color paint, it is necessary to change the rotating speed of the spray head every time the color of the paint to be painted is changed. To this end, in such a rotary type electrostatic spray painting device, the nozzle of the air turbine is connected to the pressurized air source via a plurality of air supply conduits, and a solenoid valve and an air jet forming a restricted opening are arranged in each air supply conduit. The flow areas of the air jets are different from each other. The rotating speed of the spray head is controlled in such a way that the amount of pressurized air is changed stepwise by selectively opening one of the solenoid valves in accordance with a change in color of the paint to be painted.

However, where the amount of pressurized air fed into the air turbine is controlled due to differences in the flow areas of the air jets, when the pressure of the pressurized air source fluctuates, or when the load acting on the shaft fluctuates due to a change in the viscosity of the paint, the rotating speed of the rotary shaft changes. Therefore, a problem occurs in that it is difficult to maintain the rotating speed of the spray head at a predetermined optimum speed.

SUMMARY OF THE INVENTION

An object of the present invention is to provide a rotary type electrostatic spray painting device capable of maintaining the rotating speed of the spray head at a predetermined optimum speed.

According to the present invention, there is provided a rotary type elelctrostatic spray painting device comprising: a housing; a rotary shaft rotatably supported within the housing and having a front end and a rear end face which has a reflecting face portion and a non-reflecting face portion formed thereon; a spray head fixed onto the front end of the rotary shaft; detecting means arranged to alternately face the reflecting face portion and the non-reflecting face portion and receiving light reflected from the reflecting face portion, the detecting means producing an output signal representing the rotating speed of the rotary shaft; an air turbine for providing a rotational force for the rotary shaft; a pressurized air source; an air supply conduit connecting the pressurized air source to the air turbine; valve means arranged in the air supply conduit to control the amount of air fed into the air turbine; and control means actuating the valve means in response to the output signal of the detecting means to equalize the rotating speed of the rotary shaft to a predetermined rotating speed.

The present invention may be more fully understood from the description of a preferred embodiment of the invention set forth below, together with the accompanying drawings.

DESCRIPTION OF THE PREFERRED EMBODIMENT

Figure 1:
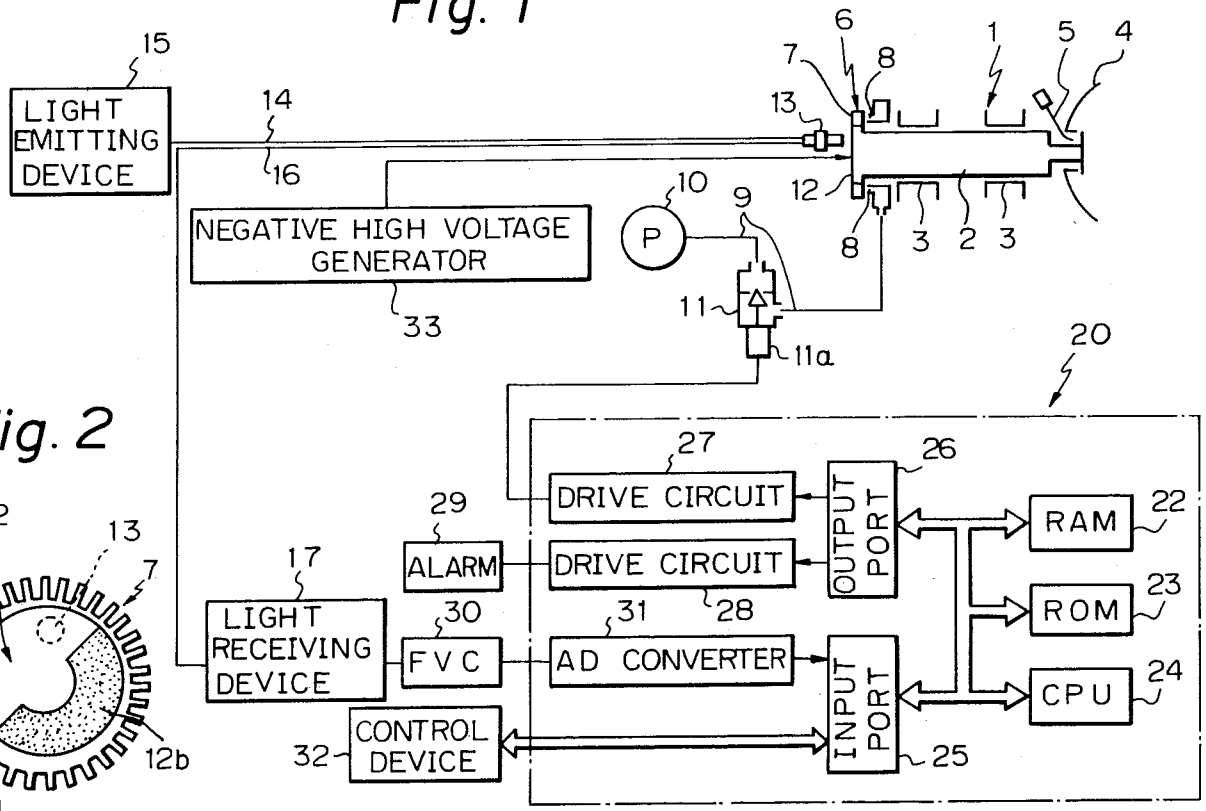
FIG. 1 is a schematically illustrated view of a painting device according to the present invention.

Referring to FIG. 1, reference numeral 1 designates a rotary type electrostatic spray painting device, 2 a rotary shaft rotatably supported by air bearings 3, 4 a cup shaped spray head fixed onto the front end of the rotary shaft 2, and 5 a paint feed nozzle for feeding paint onto the cup shaped inner wall of the spray head 4; 6 an air turbine for driving the rotary shaft 2, 7 a turbine wheel mounted on the rear end of the rotary shaft 2, and 8 air nozzles for injecting air towards the turbine blades of the turbine wheel 7. The air nozzles 8 are connected to a pressurized air source 10 via an air supply conduit 9. The pressurized air injected from the air nozzles 8 provides a rotational force for the rotary shaft 2, and thus the rotary shaft 2 is rotated at a high speed. A negative high voltage is applied to the rotary shaft 2 by means of a negative high voltage generator 33, and this negative high voltage is applied to the spray head 4 via the rotary shaft 2. Paint fed from the paint feed nozzle 5 flows onto the cup shaped inner wall of the spray head 4, and then the paint is discharged from the front end of the spray head 4 towards a vehicle body to be painted, in the form of paint particles charged with electrons.

As illustrated in FIG. 1, a flow control valve 11 actuated by a linear solenoid **11*a* is arranged in the air supply conduit 9, and the linear solenoid 11*a* is controlled by the output signal of an electronic control unit 20**.

The electronic control unit 20 is constructed as a digital computer and comprises a RAM (random access memory) 22, ROM (read only memory) 23, CPU (microprocessor, etc.) 24, an input port 25, and an output port 26. The RAM 22, the ROM 23, the CPU 24, the input port 25 and the output port 26 are interconnected to each other via a bidirectional bus. The output port 26 is connected to the linear solenoid **11*a* via a drive circuit 27 and also connected to an alarm device 29 via a circuit 28**.

Figure 2:
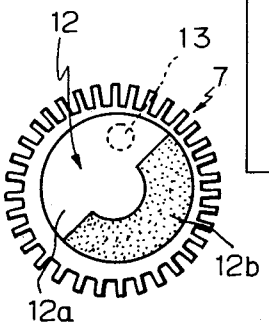
FIG. 2 is a front view of the rear end face of the turbine wheel of a painting device according to the present invention.

As illustrated in FIG. 1, a rotating speed sensor 13 is stationarily arranged adjacent to the rear end face 12 of the turbine wheel 7, that is, the rear end face 12 of the rotary shaft 2. As illustrated in FIG. 2, a reflecting face portion **12*a* and a non-reflecting face portion 12*b* located opposite to the reflecting face portion 12*a* relative to the center of the rear end face 12 of the turbine wheel 7 are formed on the rear end face 12 of the turbine wheel 7. The reflecting face portion 12*a* occupies one half of the rear end face 12 of the turbine wheel 7, and the non-reflecting face portion 12*b* occupies the remaining half of the rear end face 12 of the turbine wheel 7. The reflecting face portion 12*a* is formed by, for example, a mirror-finish of the rear end face 12 of the turbine wheel 7, and the non-reflecting face portion 12***b* is formed by anodizing the rear end face 12 of the turbine wheel 7 so as to cause an irregular reflection. As illustrated by the broken line in FIG. 2, the rotating speed sensor 13 is arranged at a position wherein it alternately faces the reflecting face portion 12*a* and the non-reflecting face portion 12*b* when the rotary shaft 2 rotates. As illustrated in FIG. 1, the rotating speed sensor 13 is connected, on one hand, to a light emitting device 15 via a fiber 14 and, on the other hand, to a light receiving device 17 via a fiber 16. The light emitting device 15 comprises, for example, a light-emitting diode, and the light emitted from the light emitting device 15 is directed to the reflecting face portion 12*a* or the non-reflecting portion 12*b* via the fiber 14. This light is received by the rotating speed sensor 13 as a reflected light only when the rotating speed sensor 13 faces the reflecting face portion 12*a*, and the light thus received is introduced into the light receiving device 17 via the fiber 16. The light receiving device 17 comprises, for example, a photo diode receiving the light from the fiber 16 and producing an output signal, and an amplifier amplifying the output signal of the photo diode. Thus, when the rotary shaft 2 rotates, the light receiving device 17 produces output pulses having a frequency proportional to the rotating speed of the rotary shaft 2. The output pulses of the light receiving device 17 are converted to a voltage proportional to the frequency of the output pulses in an FVC (frequency-voltage converter) 30, and then the output voltage of the FVC 30 is input to the input port 25 after being converted to the corresponding binary code in an AD converter 31. A control device 32 for controlling the overall painting process is connected to the input port 25 and produces an output signal which, for example, represents the color of the paint to be painted in the next painting operation.

The operation of the painting device according to the present invention will be hereinafter described with reference to FIGS. 1 and 3.

Figure 3:
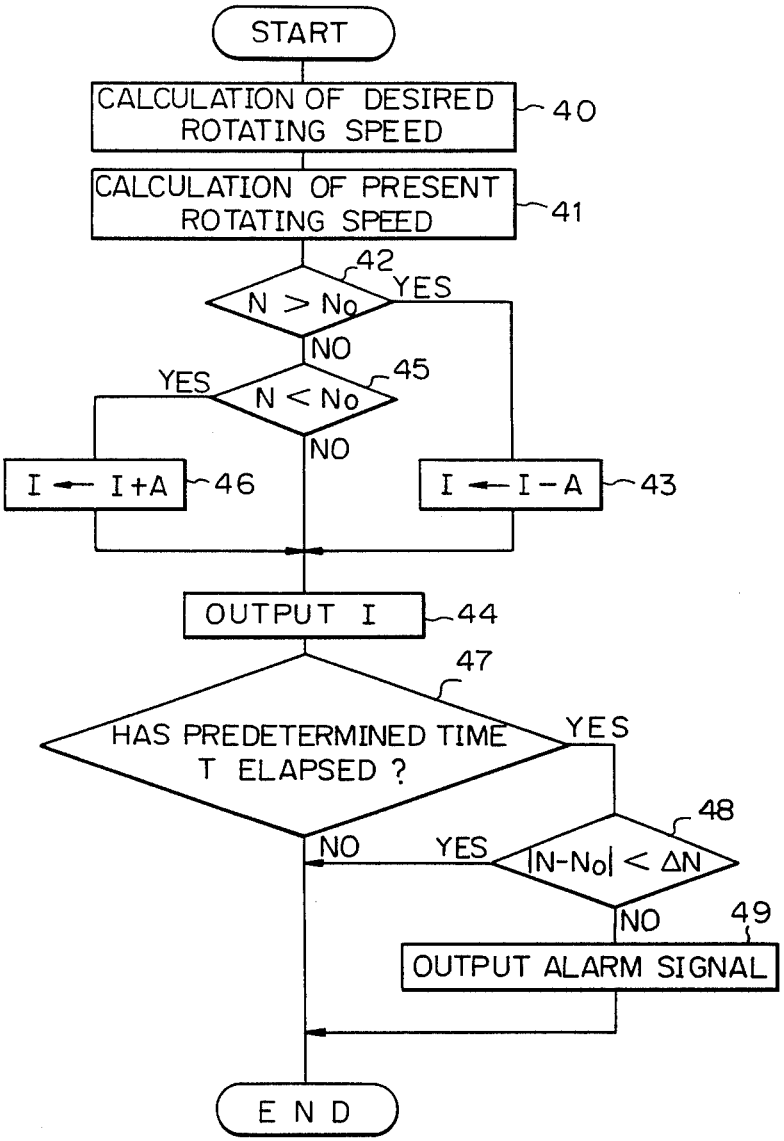
FIG. 3 is a flow chart for executing a rotating speed control according to the present invention.

Referring to FIG. 3, in step 40, the output signal of the control device 32, representing the color of paint to be painted, is input to the CPU 24, and then a desired rotating speed $N_0$ which is optimum for the color of the paint is calculated from data stored in the ROM 23. Then, in step 41, the present rotating speed N of the rotary shaft 2 is calculated from the output signal of the rotating speed sensor 13. Then, in step 42, it is determined whether the present rotating speed N is higher than the desired rotating speed $N_0$. If $N > N_0$, the routine goes to step 43 and a fixed value A is subtracted from a current value I. Then, the routine goes to step 44, and data representing the current value I is output to the output port 26. Contrary to this, if $N \leqq N_0$, the routine goes to step 45, and it is determined whether the present rotating speed N is lower than the desired rotating speed $N_0$. If $N < N_0$, the routine goes to step 46, and a fixed value A is added to a current value I. Then, in step 44, data representing the current value I is output to the output port 26. If it is determined in step 45 that N is not lower than $N_0$, the routine goes to step 44, and data representing the current value I is output to the output port 26.

If data representing the current value I is output to the output port 26, current fed into the linear solenoid 11*a* of the flow control valve 11 is controlled on the basis of this data. The flow area of the flow control valve 11 increases as the current fed into the linear solenoid 11*a* increases. As mentioned above, when the present rotating speed N is higher than the obtained rotating speed $N_0$, the current value I is gradually reduced every time the routine illustrated in FIG. 3 is executed. Consequently, since the flow area of the flow control valve 11 is gradually reduced, the amount of air fed into the air nozzle 8 is gradually decreased, and thus the rotating speed of the rotary shaft 2 is gradually decreased. Contrary to this, when the present rotating speed N is lower than the desired rotating speed $N_0$, the current value I is gradually increased, and thus the flow area of the flow control valve 11 is gradually increased. As a result, since the amount of air fed into the air nozzles 8 is gradually increased, the rotating speed of the rotary shaft 2 is gradually increased. Therefore, where the present rotating speed N is deviated from the desired rotating speed $N_0$, the rotating speed N gradually approaches the desired rotating speed $N_0$ and finally becomes equal to the desired rotating speed $N_0$.

After data representing the current value I is output to the output port 26, the routine goes to step 47. In step 47, it is determined whether a predetermined time T has elapsed after data representing the color of paint is input to the CPU 24 from the control device 32. If the predetermined time T has not elapsed, the processing cycle is completed, and the routine starts again from step 40 in the next cycle. Contrary to this, if the predetermined time T has elapsed, the routine goes to step 48, and it is determined whether the difference $/N-N_0/$ between the present rotating speed N and the desired rotating speed $N_0$ is smaller than a predetermined valve $\Delta N$. If $/N-N_0/ < \Delta N$, the processing cycle is completed. If $/N-N_0/ \geqq \Delta N$, the routine goes to step 49, and an alarm signal is output to the output port 26. At this time, the alarm device 29 is operated. As mentioned above, when the predetermined time T has elapsed after the control device 32 produces an output signal representing the color of the paint, if the rotating speed N does not become approximately equal to the desired rotating speed $N_0$, the alarm device 29 is operated to inform an operator of an abnormal state. As a result, it is possible to determine a malfunction of the painting device at an early stage and, particularly in a production line where there is a long delay between the painting process and the quality inspection process, it is possible to prevent the production of a large number of articles having unsatisfactory paint surfaces.

According to the present invention, since it is possible to maintain the rotating speed of the rotary shaft at a speed which is optimum for the color of the paint, regardless of the fluctuation of pressure in the pressurized air source and irrespective of fluctuations of the load caused by a change in the viscosity of the paint, it is possible to improve the paint quality. In addition, the painting device according to the present invention does not require a plurality of air feed conduits in addition to a plurality of solenoid valves. Therefore, it is possible to minimize the size of the painting device and reduce the manufacturing and maintenance costs of the painting device. Furthermore, since the rotating speed of the rotary shaft can be detected by simply forming the reflecting face portion and the non-reflecting face portion on the rear end face of the rotary shaft, no imbalance occurs at the rotary shaft, and thus it is possible to obtain stable rotation of the rotary shaft for a long time.

While the invention has been described by reference to a specific embodiment chosen for purposes of illustration, it should be apparent that numerous modifications could be made thereto by those skilled in the art without departing from the basic concept and scope of the invention.

We claim:

1. A rotary type electrostatic spray painting device, comprising:

a housing;

a rotary shaft rotatably supported within said housing and having a front end and a rear end face which forms a reflecting face portion and a non-reflecting face portion thereon;

a spray head fixed onto the front end of said rotary shaft;

detecting means arranged to alternately face said reflecting face portion and said non-reflecting face portion and for receiving receiving light reflected from said reflecting face portion, said detecting means producing an output signal representing the rotating speed of said rotary shaft;

an air turbine for providing a rotational force for said rotary shaft;

a pressurized air source;

an air supply conduit connecting said pressurized air source to said air turbine;

valve means arranged in said air supply conduit to control the amount of air fed into said air turbine; and control means for actuating said valve means in response to the output signal of said detecting means to equalize the rotating speed of said rotary shaft to a predetermined rotating speed wherein said control means comprises timer means for calculating a time elapsed after said control device produces said output signal, and an alarm device operated when said elapsed time exceeds a predetermined time and when the difference between the rotating speed of said rotary shaft and said desired rotating speed is larger than a predetermined speed.

2. A rotary type electrostatic spray painting device according to claim 1, wherein said air turbine comprises a turbine wheel integrally formed on said rotary shaft and forming said rear end face which forms said reflecting face portion and said non-reflecting face portion.

3. A rotary type electrostatic spray painting device according to claim 2, wherein said reflecting face portion occupies one half of said rear end face, and said non-reflecting face portion occupies the other half of said rear end face.

4. A rotary type electrostatic spray painting device according to claim 1, wherein said reflecting face portion is formed by a mirror finished face, and said non-reflecting face portion is formed by an anordized face.

5. A rotary type electrostatic spray painting device according to claim 1, wherein said detecting means comprises a rotating speed sensor arranged adjacent to said rear end face, a light emitting device connected to said rotating speed sensor to direct light towards said reflecting face portion and said non-reflecting face portion, and a light receiving device connected to said rotating speed sensor to receive the light reflected on said reflecting face portion and produce an output signal representing the rotating speed of said rotary shaft.

6. A rotary type electrostatic spray painting device according to claim 5, wherein said light emitting device is connected to said rotating speed sensor via a fiber, and said light receiving device is connected to said rotating speed sensor via a fiber.

7. A rotary type electrostatic spray painting device according to claim 5, wherein said detecting means comprises an FVC for converting the output signal of said light receiving device to a voltage signal representing the rotating speed of said rotary shaft.

8. A rotary type electrostatic spray painting device according to claim 1, wherein said valve means comprises a linear solenoid.

9. A rotary type electrostatic spray painting device according to claim 1, wherein said control means comprises a control device producing an output signal representing a color of paint to be painted, and a memory memorizing a desired rotating speed which is optimum for the color of paint, said rotating speed being controlled to become equal to said desired speed in accordance with the output signal of said control device.

* * * * *